United States Patent [19]

Fischer et al.

[11] 4,307,811

[45] Dec. 29, 1981

[54] NONREFILLING BOTTLE CLOSURE

[76] Inventors: Marc Fischer, 5, rue Coste, Caluire (Rhone); Marcel Riffet, 10, rue du President Carnot, Lyon, (Rhone); Ghislaine Fischer nee Veron, 5, rue Coste, Caluire (Rhone), all of France

[21] Appl. No.: 168,274

[22] Filed: Jul. 10, 1980

[30] Foreign Application Priority Data

Jul. 11, 1979 [FR] France ..... 79 18512

[51] Int. Cl.[3] ..... B65D 49/02

[52] U.S. Cl. ..... 215/26; 215/17

[58] Field of Search ..... 215/17, 18, 21, 24, 215/26

[56] References Cited

U.S. PATENT DOCUMENTS

| | | | |
|---|---|---|---|
| 2,382,864 | 8/1945 | Diaz | 215/26 X |
| 2,763,391 | 9/1956 | Hunn | 215/26 |
| 2,845,195 | 7/1958 | Libera | 215/26 X |

*Primary Examiner*—George T. Hall

*Attorney, Agent, or Firm*—Karl F. Ross

[57] ABSTRACT

A security stopper or other closure for a bottle comprises a valve which rests upon its seat except when the contents of a bottle are to be poured out through the stopper which thereby serves as a dispenser. The valve and seat arrangement is located at the lower portion of the plug-like body, the upper portion of which is provided from top to bottom with an upper baffle, an intermediate grill and a lower baffle to prevent access to the valve by a tool inserted through the pouring spout of the dispenser and thereby precluding refilling by dislocation of the valve.

4 Claims, 5 Drawing Figures

FIG.1
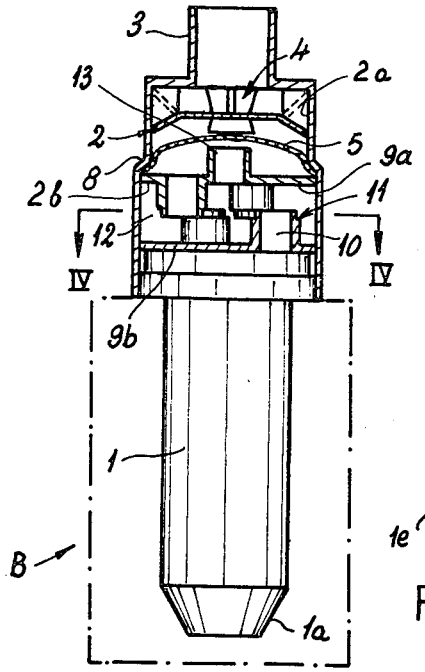
FIG.2
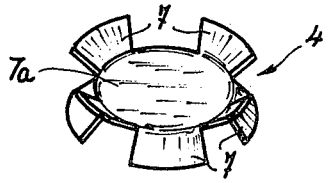
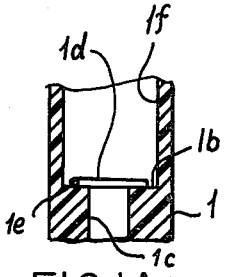
FIG.1A
FIG.3
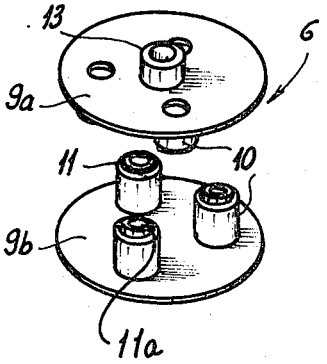
FIG.4
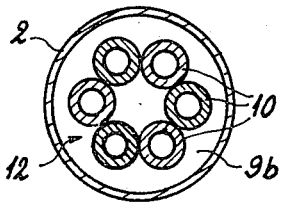

NONREFILLING BOTTLE CLOSURE

FIELD OF THE INVENTION

The present invention relates to a security dispenser and, more particularly, to a plug or stopper-like dispenser for a bottle or other container which permits pouring of the contents but prevents refilling of the bottle.

BACKGROUND OF THE INVENTION

The large number of cases in which bottles and other containers are fraudulently refilled with liquids other than their original contents has led to an interest in a dispensing-type closure for such containers which will permit the original liquid to be dispensed by tilting the bottle, i.e. turning the mouth and the dispenser plug downwardly, while precluding refilling of the bottle when the latter is in an upright position. To this end, the dispenser closure or plug which can be sealed in the mouth of the bottle, can be provided with a valve member which, in the upright position of the bottle, rests upon a seat but, when the bottle is tilted sufficiently, will be removed from the seat to permit dispensing of the liquid.

When the valve is in its closed state, a liquid poured into the closure cannot penetrate beyond the valve member and thus refilling of the bottle is precluded.

To avoid dislocation of the valve member, e.g. by a tool inserted into the plug or closure through the pouring spout or opening, it has been proposed to provide such dispensing closures with a baffle arrangement in the upper portion of the plug. The baffle arrangement is designed to bar penetration of a valve-lifting tool into the lower portion of the device and thus secure the latter against movement of the valve member when the bottle is in an upright position.

Prior art baffle arrangements are either so efficient in barring insertion of the tool that they interfere with proper flow of liquid past the baffle and thus from the dispenser. Where proper flow is assured in these earlier cases, the baffle is insufficiently effective against penetration by a tool.

OBJECTS OF THE INVENTION

It is the principal object of the present invention to provide an antirefilling dispensing closure for a liquid container whereby the disadvantages of the prior art systems are avoided.

Another object of this invention is to provide an antirefilling plug or stopper which effectively blocks refilling and yet permits smooth flow of the liquid from the bottle.

SUMMARY OF THE INVENTION

These objects and others which will become apparent hereinafter are attained, in accordance with the present invention, with a safety plug or antirefilling closure for the purposes described which is formed with a lower chamber having a valve permitting flow of liquid through the dispenser when the bottle is tilted into a pouring position but barring the inflow of liquid in all other positions, and an upper chamber communicating with the lower chamber and formed from top to bottom with a disk-shaped baffle, a convex grill and an offset-passage baffle, the three being disposed one below the next in the second chamber.

According to a feature of the invention, the upper or disk baffle is provided with a disk-shaped imperforate cylindrical portion spaced from but juxtaposed with a cylindrical pouring spout of the plug and is further provided with a plurality of rigid flaps or fins alternately turned upwardly and downwardly along the periphery of the imperforate central portion. These oppositely turned flaps permit flow of the liquid around the disk-shaped central plate.

According to another feature of the invention, the intermediate member is a grill which is upwardly convex and is lodged in a step of a tubular sleeve forming the upper chamber of the plug.

The lower baffle is constituted by two disks injection molded from synthetic resin material and formed each on one side with three small tubes forming passages traversing the disk and disposed in angularly equispaced relationship about the axis of the plug and of the disks, the disks being dimensioned so that the tube of one disk can be received between two tubes of the other disk with all of the tubes being disposed in contiguous relationship about this axis and having their centers lying along a circle centered on the axis. The disks are dimensioned so that each of the tubes forms a shoulder against which the shoulder of the tubes of the other disk can lie, thereby permitting a meandering path for the liquid to be formed.

Advantageously, the upper disk also is provided with a central tube whose function is to improve the uniformity of flow of the liquid through the device.

All of the elements of the device, except the upper baffle and grill, may be composed of synthetic resin material.

BRIEF DESCRIPTION OF THE DRAWING

The above and other objects, features and advantages of the present invention will become more readily apparent from the following description, reference being made to the accompanying drawing in which:

FIG. 1 is an elevational view of a nonrefilling plug and dispenser for a bottle, e.g. a perfume or alcoholic beverage container, according to the invention, with the upper portion seen in axial section; .

FIG. 1A is a diagrammatic section showing a valve arrangement for the lower portion of the plug in FIG. 1;

FIG. 2 is a perspective view of the upper baffle;

FIG. 3 is an exploded perspective view of the lower baffle; and

FIG. 4 is a section taken along the line IV—IV of FIG. 1.

SPECIFIC DESCRIPTION

The plug shown in FIG. 1 comprises two bodies 1 and 2, respectively constituting the lower or plug portion and an upper dispenser portion of the device.

The lower portion 1 has a generally cylindrical configuration and a frustoconically convergent tip 1*a* enabling the device to be tightly inserted into the mouth and neck of a bottle B containing a liquid to be dispensed and enabling the device to be sealed therein.

This lower portion 1 can contain any suitable valve which permits dispensing of the liquid when the body is turned to tilt its neck downwardly, but otherwise barring the inflow of a counterfeit liquid into the bottle. For example, as shown in FIG. 1A, the bottom portion 1 can be provided with a seat 1*b* surrounding passage 1*c* communicating with the interior of the bottle and overlain by a valve flap 1*d* which is hinged at 1*e* to the lower portion 1.

This mechanism thus permits the flap 1*d* to move away from the seat when the liquid is poured and thus represents a two-way valve permitting emptying of the bottle but precluding refilling thereof.

The upper portion 2 of the dispenser, which comprises a stepped cylindrical sleeve bonded to the lower portion 1, is formed with a cylindrical pouring spout 3 and contains a structure preventing insertion of a tool through the spout 3 to dislodge the valve member 1*d*.

As described above, the invention represents an improvement in the structure within the upper portion of the device.

The upper sleeve 2 forms a chamber receiving three individual elements, namely, an upper baffle 4, an intermediate grill 5 and a lower baffle 6.

The upper baffle 4 is constituted by a metal disk having a circular imperforate central portion 7*a* formed along its periphery with radial wings or fins 7 offset alternately upwardly and downwardly and dimensioned to lock the upper baffle 4 within the cylindrical upper part 2*a* of the sleeve 2.

The metallic grill 5 is upwardly convex and is resiliently seated, along its periphery, against a shoulder 8 formed between the upper cylindrical portion 2*a* and the lower cylindrical portion 2*b* of the sleeve 2.

The lower baffle 6 which likewise is seated against the shoulder 8, e.g. the periphery of the upwardly convex grill 5, is constituted by two synthetic resin disks 9*a* and 9*b*.

Each of these disks is formed with three small tubes or chimneys 10 angularly offset from one another at 120° about the axis of the disk and thus having centers lying along an imaginary circle centered on the disk.

Each of the tubes 10 is formed at its free end with a shoulder 11 and the diameters of the tubular bosses 11*a* surrounded by the shoulders are such that the two disks can be nested as shown in FIG. 1 with their tubes angularly offset by 60° from one another. The bosses of one disk are received between the bosses of the other disk so that the tubes of the two disks are disaligned from one another.

The two disks 9*a* and 9*b* axially delimit a chamber 12 which communicates with the passage 1*f* of the lower part of the plug by the tubes 10 of disk 9*a*. The chamber 12 thus serves to permit liquid communication between the upper and lower parts of the plug but because of the disalignment of the tubes of one disk from the tubes of the other, it is impossible to introduce any object through the plug to operate upon the flap 1*d*.

To ensure uniformity of flow of the liquid from the dispenser, the upper disk 9*a* of the baffle 6 is provided with a central tube 13 extending upwardly (FIG. 1) and practically abutting the center of the upwardly convex grill 5.

Experience has shown that the combination of the upper baffle 4, the intermediate grill 5 and the lower baffle 6 makes it impossible to insert any device capable of lifting the valve member 1*d* and thus umblocking the mechanism contained in the lower part of the plug.

Surprisingly, the flow of liquid when the bottle is tilted is uniform and smooth, presumably because of the many passages in the two baffles and in the grill so that air can pass into the bottle as the liquid flows.

We claim:

1. An antirefill closure for a receptacle comprising:

an elongated body adapted to be mounted on said receptacle and formed with a passage communicating with the interior thereof at a lower portion of said body and an outlet at a portion of said body for dispensing liquid from said receptacle;

a valve mechanism in the lower portion of said body permitting flow of liquid from said receptacle but blocking flow of liquid into said receptacle through said body, said upper portion of said body being formed with a chamber;

a lower baffle in said chamber proximal to said lower portion and provided with sets of nonaligned passages;

an upwardly convex intermediate grill above said lower baffle in said chamber; and an upper baffle between said outlet and said grill in said chamber formed as a disk having alternately offset radial fins along the periphery of said disk, said baffles and grill forming an assembly preventing insertion of a tool capable of opening said valve mechanism.

2. The closure defined in claim 1 wherein said lower baffle comprises a pair of synthetic resin disks each having a plurality of angularly equispaced tubes turned toward the other disk of said lower baffle, each of said tubes being formed at an end with a radial shoulder bearing upon the shoulder of an opposing disk of said lower baffle whereby said passages of the disks of said lower baffle interfit and have centers lying along an imaginary circle centered on the axis of said lower baffle.

3. The closure defined in claim 2 wherein the uppermost disk of said lower baffle is formed with a central tube extending upwardly to substantially abut said grill.

4. The closure defined in claim 1, claim 2 or claim 3 wherein said body is formed as a plug with said lower portion receivable in the mouth of a bottle.

* * * * *